US006006834A

United States Patent [19]

Skinner

[11] Patent Number: 6,006,834

[45] Date of Patent: Dec. 28, 1999

[54] FORMATION EVALUATION TESTING APPARATUS AND ASSOCIATED METHODS

[75] Inventor: Neal G. Skinner, Lewisville, Tex.

[73] Assignee: Halliburton Energy Services, Inc., Dallas, Tex.

[21] Appl. No.: 08/955,682

[22] Filed: Oct. 22, 1997

[51] Int. Cl.[6] ..... E21B 47/00

[52] U.S. Cl. ..... 166/250.17; 166/386; 166/100; 166/187

[58] Field of Search ..... 166/250.17, 386, 166/387, 100, 114, 116, 187, 205; 175/50

[56] References Cited

U.S. PATENT DOCUMENTS

| | | | |
|---|---|---|---|
| 4,566,535 | 1/1986 | Sanford | 166/250.17 |
| 5,540,280 | 7/1996 | Schultz et al. | 166/250.07 |
| 5,555,945 | 9/1996 | Schultz et al. | 175/50 |
| 5,687,791 | 11/1997 | Beck et al. | 166/250.07 |
| 5,803,186 | 9/1998 | Berger et al. | 166/250.17 |

*Primary Examiner*—William Neuder
*Attorney, Agent, or Firm*—William M. Imwalle; Marlin R. Smith

[57] ABSTRACT

A formation testing apparatus and associated methods provide efficient and convenient evaluation of formations. In a described embodiment, a formation testing apparatus has a pair of relatively closely spaced apart inflatable packer elements exteriorly disposed thereon. When positioned opposite a formation, the packer elements are inflated to substantially isolate a volume of the wellbore adjacent the formation. With the packer elements inflated and sealingly engaging the formation, the elements are alternately further inflated and partially deflated to thereby alternately expand and compress the volume therebetween. The volume is in fluid communication with an interior fluid passage of the apparatus, and the alternate expansion and compression of the volume results in fluid being pumped through the fluid passage.

39 Claims, 9 Drawing Sheets

FORMATION EVALUATION TESTING APPARATUS AND ASSOCIATED METHODS

BACKGROUND OF THE INVENTION

The present invention relates generally to operations performed in a subterranean well and, in an embodiment described herein, more particularly provides a formation testing apparatus and associated methods of testing a formation.

It is well known in the subterranean well drilling and completion arts to perform tests on formations intersected by a wellbore. Such tests are typically performed in order to determine geological and other physical properties of the formations and fluids contained therein. For example, by making appropriate measurements, a formation's permeability and porosity, and the fluid's resistivity, temperature, pressure, and bubble point may be determined. These and other characteristics of the formation and fluid contained therein may be determined by performing tests on the formation before the well is completed.

It is of considerable economic importance for tests such as those described hereinabove to be performed as soon as possible after the formation has been intersected by the wellbore. Early evaluation of the potential for profitable recovery of the fluid contained therein is very desirable. For example, such early evaluation enables completion operations to be planned more efficiently.

Where the early evaluation is actually accomplished during drilling operations within the well, such as during a wiper trip, the drilling operations may also be more efficiently performed, since results of the early evaluation may then be used to adjust parameters of the drilling operations.

In typical formation testing equipment suitable for interconnection with a drill string during drilling operations, various devices and mechanisms are provided for isolating a formation, or portion of a formation, from the remainder of the wellbore, drawing fluid from the formation, and measuring physical properties of the fluid and the formation. For isolating the formation and drawing fluid from the formation, separate mechanisms are generally provided. For example, a pad having a seal element thereon and a fluid passage formed therein may be pressed against the formation and a piston within a sampling tool may be displaced to cause fluid to flow from the formation into the fluid passage. Unfortunately, these mechanisms are usually relatively complex and expensive to manufacture, and require manipulation of the drill string to displace the piston, etc.

Therefore, it would be quite desirable to provide a method of performing an early formation evaluation test, which does not require separate formation isolation and fluid pumping mechanisms, and which does not require manipulation of the drill string to perform either of these functions. Furthermore, it would be desirable to provide an apparatus which is usable to perform the method, and which may be used to inject fluid into the formation, for example, to stimulate the formation. It is, thus, an object of the invention to provide such methods and apparatus.

SUMMARY OF THE INVENTION

In carrying out the principles of the present invention, in accordance with an embodiment thereof, a formation evaluation testing apparatus is provided. The apparatus is operable by application of fluid pressure and does not require manipulation of a tubular string to force fluid through the apparatus. Associated methods are provided as well.

In broad terms, apparatus is provided which includes an external fluid pump and a fluid passage. The fluid pump is external to the apparatus in that fluid is forced through the fluid passage by alternate expansion and compression of a volume of the fluid external to the apparatus. In this manner, the apparatus does not require complex internal mechanisms to force fluid through the fluid passage, and does not require the apparatus, or any tubular string attached thereto, to be reciprocated or rotated within the wellbore.

In one aspect of the present invention, the fluid is alternately compressed and expanded by corresponding inflation and deflation of axially spaced apart seal elements. The volume is disposed between the seal elements, which sealingly engage the formation. Therefore, when the seal elements are further inflated after they have sealingly engaged with the formation, such continued inflation causes the volume to decrease, thereby forcing the fluid into the fluid passage.

In another aspect of the present invention, a flow control device is interconnected with the fluid passage. The flow control device may be configured to permit fluid flow through the fluid passage either to or from the volume. When the flow control device is configured to permit fluid flow from the volume, alternating expansion and compression of the volume results in the fluid being pumped from the volume into the fluid passage. When the flow control device is configured to permit fluid flow from the fluid passage into the volume, alternating expansion and compression of the volume results in the fluid being pumped into the formation, in which case the apparatus may be used to inject fluid into the formation.

A flowmeter may be interconnected with the fluid passage as well. The flowmeter measures the volume of fluid drawn from, or injected into, the formation.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1A:
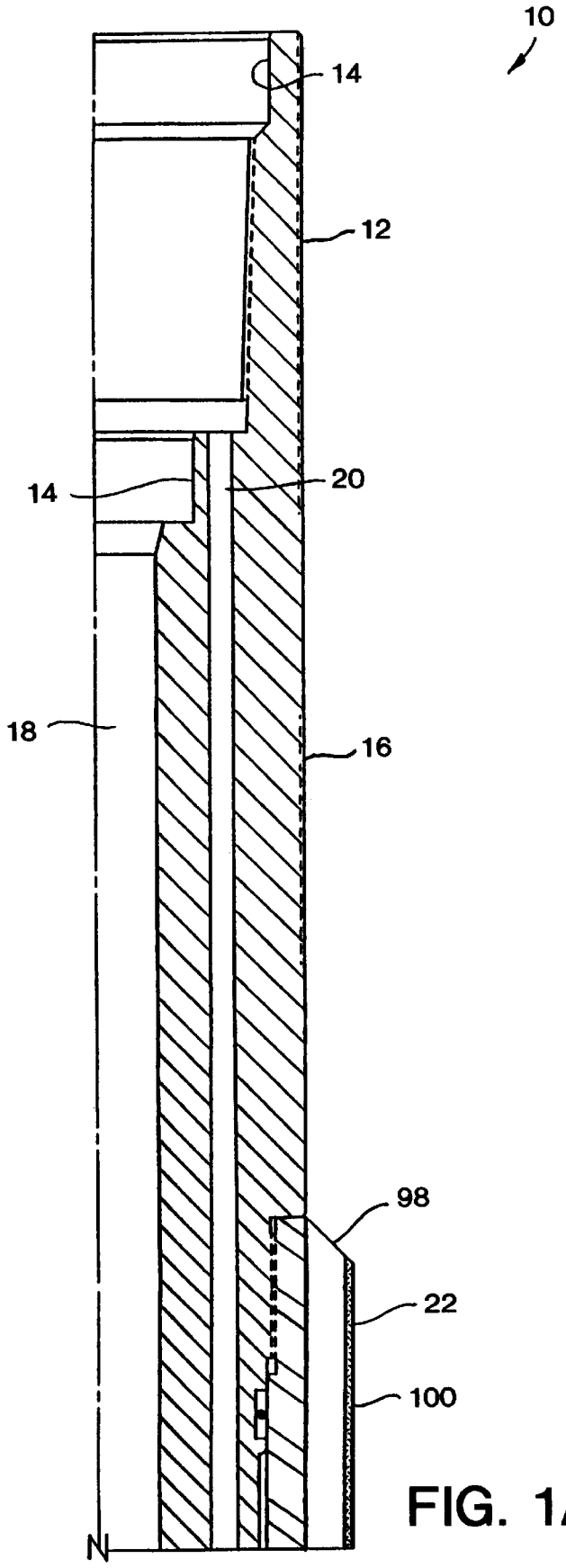
FIGS. 1A–1F are quarter-sectional views of successive axial sections of a formation testing apparatus embodying principles of the present invention.

Representatively illustrated in FIGS. 1A–1F is a formation testing apparatus 10 which embodies principles of the present invention. In the following description of the apparatus 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The apparatus 10 may be more distinctly termed a formation testing apparatus, since it functions to perform tests on fluid drawn therein from a formation intersected by a wellbore. For this purpose, the apparatus 10 may be used in conjunction with a valve actuating section of an overall formation testing system, such as that described in U.S. Pat. No. 5,791,414 entitled Early Evaluation Formation Testing System, the disclosure of which is incorporated herein by this reference. However, it is to be clearly understood that the apparatus 10 may be easily configured to inject fluid into a formation, and that the apparatus 10 may be used in conjunction with other valve actuating sections and/or other equipment, without departing from the principles of the present invention.

As referred to above, an upper end 12 of the apparatus 10 is threadedly connectable directly to a lower end of a valve actuating section (not shown). When so connected, seals carried on the valve actuating section sealingly engage two axially extending bores 14 internally formed on an axially extending generally tubular upper connector 16 of the apparatus 10.

It is to be understood that it is not necessary for the lower connector of the valve actuating section to be connected directly to the upper connector 16 according to the principles of the present invention. For example, another tubular member (not shown) could be interconnected axially between the lower connector and the upper connector 16. For this purpose, the tubular member may be provided with a lower end similar to the valve actuating section lower end, an upper end similar to the upper end 12, a flow passage permitting fluid communication with an axially extending internal flow passage 18 formed through the apparatus 10, and an inflation flow passage permitting fluid communication with an inflation flow passage 20 formed generally axially within the apparatus. In this manner, the apparatus 10 and valve actuating section may be axially spaced apart from one another as desired.

As a further example, the tubular member may be of the type which is designed to axially separate upon application of a sufficient axial tensile force thereto. In this manner, a tubular string above the tubular member, including the valve actuating section, could be retrieved from the wellbore in the event that the apparatus 10 or other portion of the tubular string therebelow became stuck in the wellbore. The following description of the apparatus 10 assumes that the apparatus 10 is directly connected to the valve actuating section, it being understood that they may actually be axially separated depending upon whether additional members are interconnected therebetween.

An axially extending generally tubular upper centralizer housing 22 is threadedly and sealingly attached to the upper connector 16. A radially extending port 24 formed through a lower tubular portion 26 of the upper connector 16 permits fluid communication between the inflation flow passage 20, an annulus 21 formed radially between the upper connector 16 and the upper centralizer housing 22 and a series of four generally axially extending openings 28 formed in the upper centralizer housing 22.

Figure 1B:
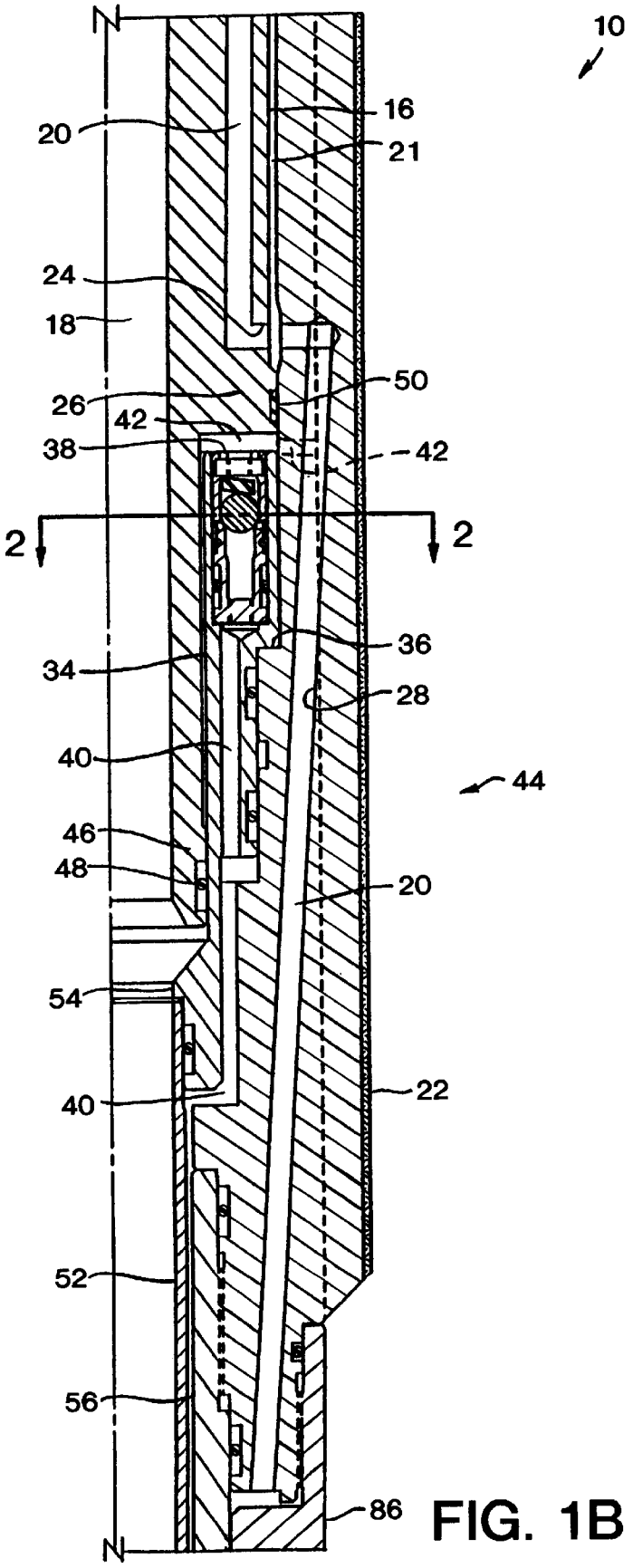
Figure 2:
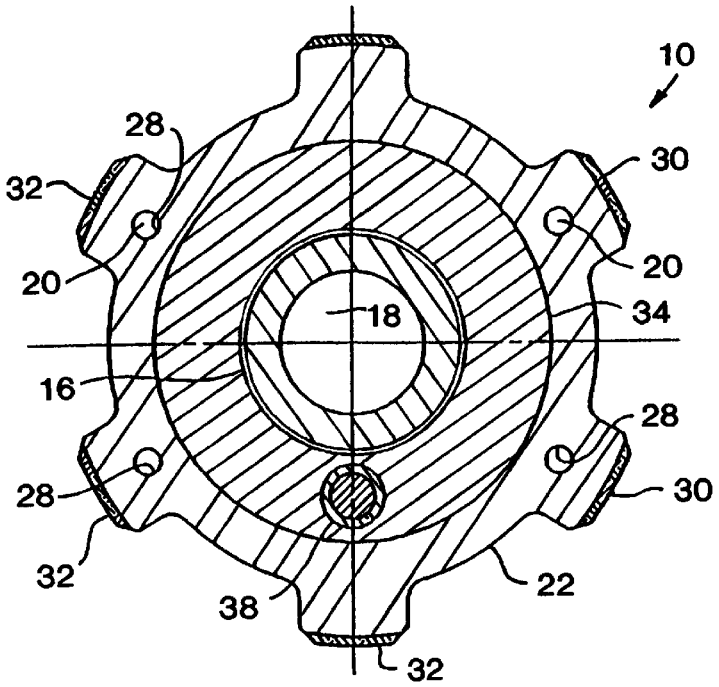
FIG. 2 is a cross-sectional view of the apparatus of FIGS. 1A–1F, taken along line 2—2 of FIG. 1B.

Referring additionally now to FIG. 2, a cross-sectional view of the apparatus 10 may be seen, taken along line 2—2 of FIG. 1B. Certain of the elements shown in FIG. 2 have been rotated about the longitudinal axis of the apparatus 10 for illustrative clarity. In this view, it may be seen that the openings 28 are circumferentially spaced apart and are radially aligned with radially outwardly and axially extending flutes 30 which are formed externally on the centralizer housing 22. Note that any number of openings 28 and/or flutes 30 may be provided and that it is not necessary for each flute to be associated with a corresponding opening. The flutes 30 enable the remainder of the apparatus 10 to be radially spaced apart from the sides of the wellbore, and may be supplied with wear-resistant coatings or surfaces 32 to deter wear due to contact between the centralizer housing 22 and the sides of the wellbore.

An axially extending generally tubular valve housing 34 is retained axially between the portion 26 of the upper connector 16 and an internal shoulder 36 formed in the centralizer housing 22. In a manner that will be more fully appreciated upon careful consideration of the further description of the apparatus 10 hereinbelow, the valve housing 34 carries a check vale 38 or other flow control device therein and is cooperatively associated with an external fluid pump of the apparatus, so that the fluid pump operates to alternately draw fluid through a fluid passage 40 and expel the fluid via an exhaust flow passage 42 to an annulus 44 formed radially between the apparatus 10 and the wellbore.

A lower radially reduced generally tubular portion 46 of the upper connector 16 is received within the valve housing 34. A circumferential seal 48 carried externally on the lower portion 46 sealingly engages the valve housing 34. Another circumferential seal 50 is carried externally on the portion 26 and sealingly engages the upper centralizer housing 22. In this manner, the exhaust flow passage 42 is isolated from the axial flow passage 18 and the inflation flow passage 20.

Note that the representatively illustrated check valve 38 is depicted as being of the type having a seat and a spring-loaded ball biased into sealing engagement with the seat, and that the check valve as installed is configured to permit fluid flow axially upward, but to prevent fluid flow axially downward, therethrough. It will, thus, be readily appreciated by one of ordinary skill in the art that if fluid pressure in the fluid passage 40 exceeds fluid pressure in the exhaust fluid passage 42 by an amount sufficient to open the check valve 38, fluid flow will be permitted from the fluid passage through the exhaust flow passage to the annulus 44. It will also be readily appreciated that the check valve 38 may be installed in the valve housing 34 in a reverse orientation, so that fluid flow is permitted axially downwardly, but not axially upwardly, therethrough. When the check valve 38 is installed in this reverse orientation, the apparatus 10 may be used to inject fluid into a formation, as will be more fully described hereinbelow. It is to be understood, however, that it is not necessary for the type of check valve 38 depicted to be utilized in the apparatus 10 according to the principles of the present invention—other flow control devices or other means of permitting, preventing, and/or limiting fluid flow between the fluid passage 40 and the exhaust flow passage 42 may alternatively be provided.

An axially extending generally tubular inner sleeve 52 is axially slidingly and sealingly received within a lower portion 54 of the valve housing 34. The inner sleeve 52 is substantially radially outwardly surrounded by an axially extending generally tubular mandrel 56. The mandrel 56 is threadedly and sealingly attached to the upper centralizer housing 22. The fluid passage 40 extends radially between the inner sleeve 52 and the mandrel 56.

Figure 1C:
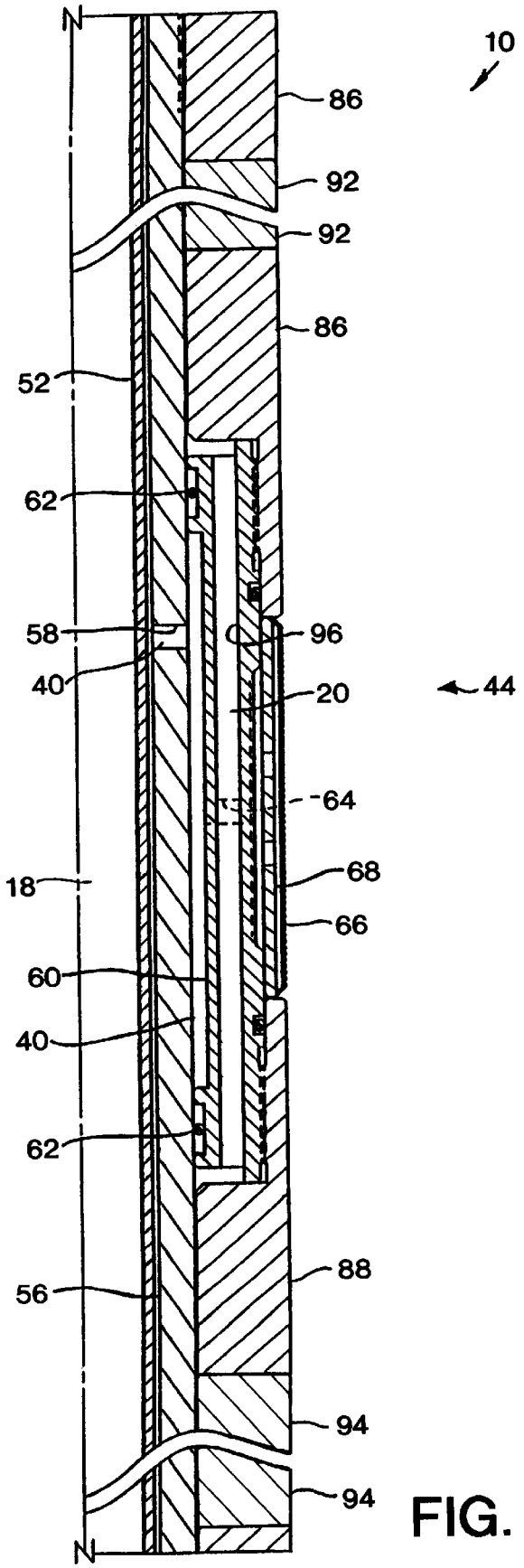
Figure 1D:
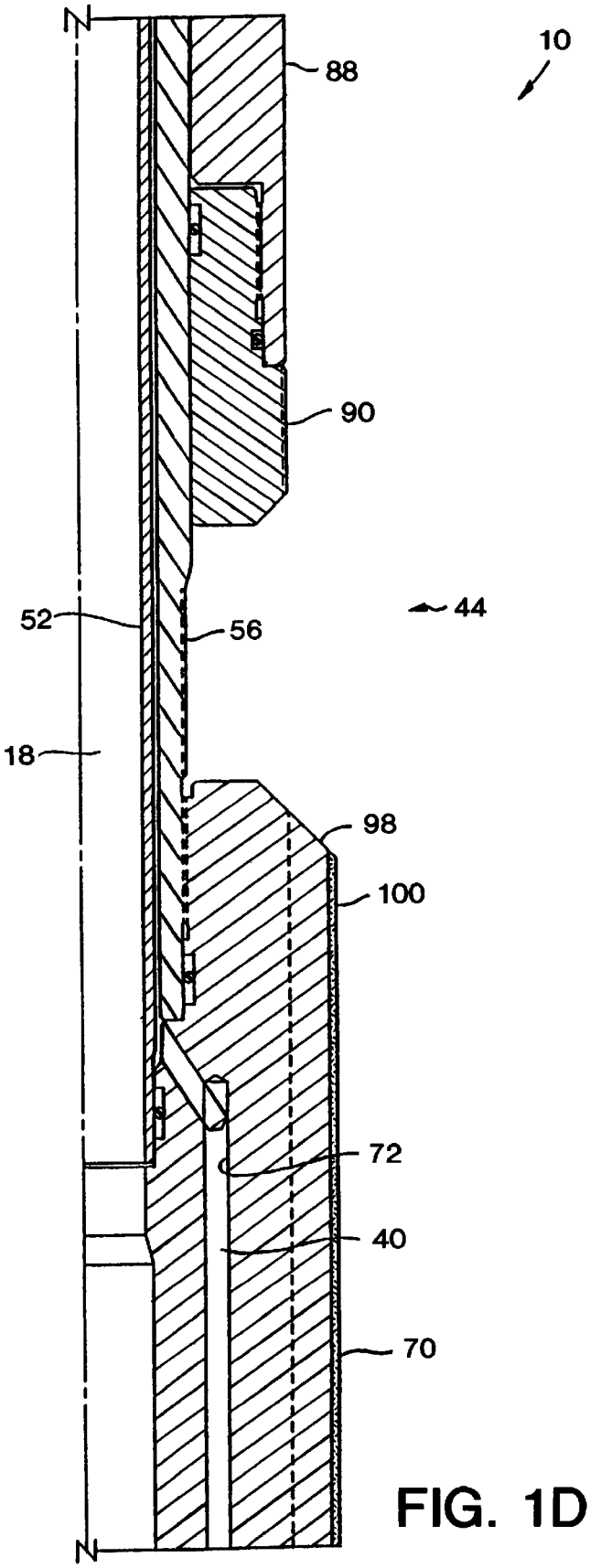

Referring specifically now to FIG. 1C, an opening 58 is formed radially through the mandrel 56, the fluid passage 40 extending through the opening. An axially extending generally tubular coupling 60 is axially slidingly and sealingly disposed exteriorly on the mandrel 56, such that the opening 58 is axially between circumferential seals 62 carried internally on the coupling. An opening 64 is formed radially through the coupling 60, thereby permitting fluid communication between the opening 58 and a generally tubular screen member 66 exteriorly disposed on the coupling. The screen member 66 includes a perforated inner tube 68.

Thus, it may be seen that the fluid passage 40 is in fluid communication with the annulus 44, and that the fluid passage permits fluid flow from the annulus 44 to the valve housing 34. When the fluid pump is operated as more fully described hereinbelow, fluid from the annulus 44 is forced into the apparatus 10 via the fluid passage 40. In the illustrated embodiment, approximately one liter of fluid is thereby drawn into the apparatus 10. The screen member 66 prevents debris from entering the apparatus 10 from the annulus 44.

Note that the fluid passage 40 extends further axially downward from the opening 58 radially between the inner sleeve 52 and the mandrel 56. The mandrel 56 is threadedly and sealingly attached to a lower centralizer housing 70. The inner sleeve 52 is slidingly and sealingly received in the lower centralizer housing 70, and is thus axially retained axially between the lower centralizer housing and the valve housing lower portion 54.

Figure 1E:
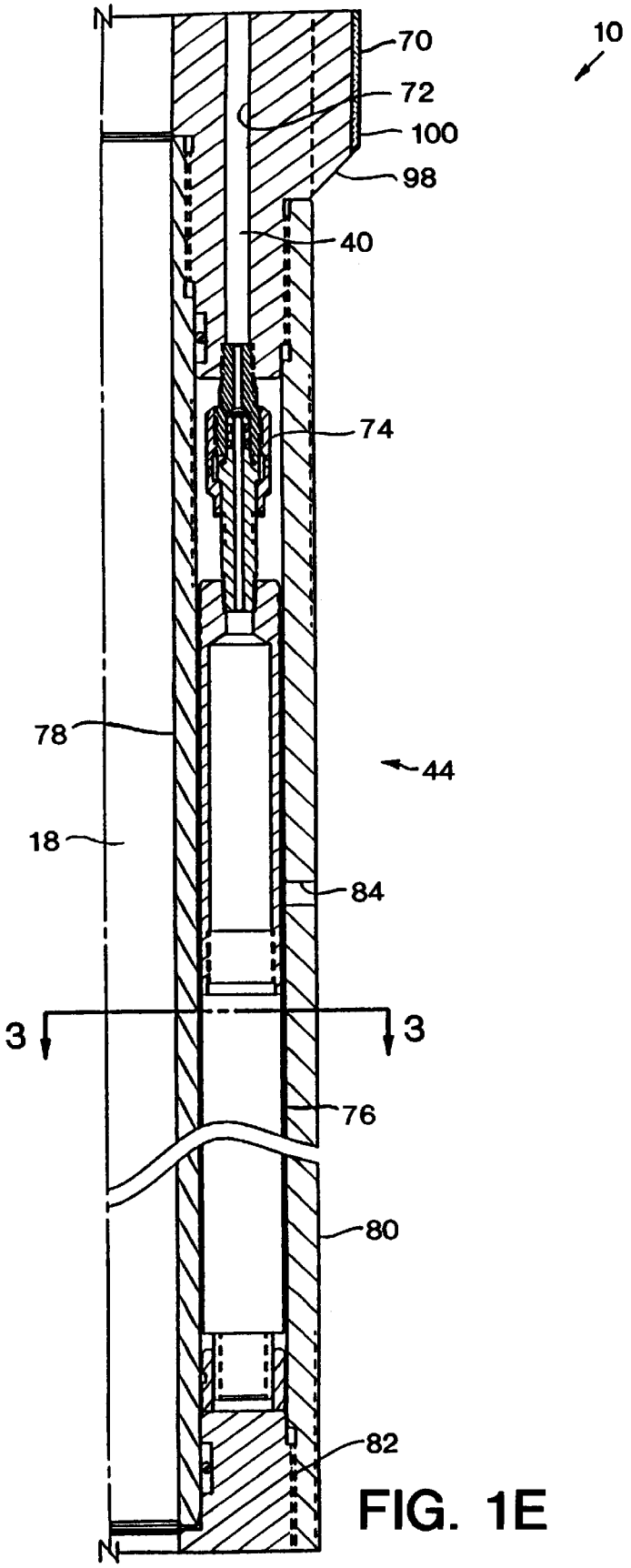
Figure 1F:
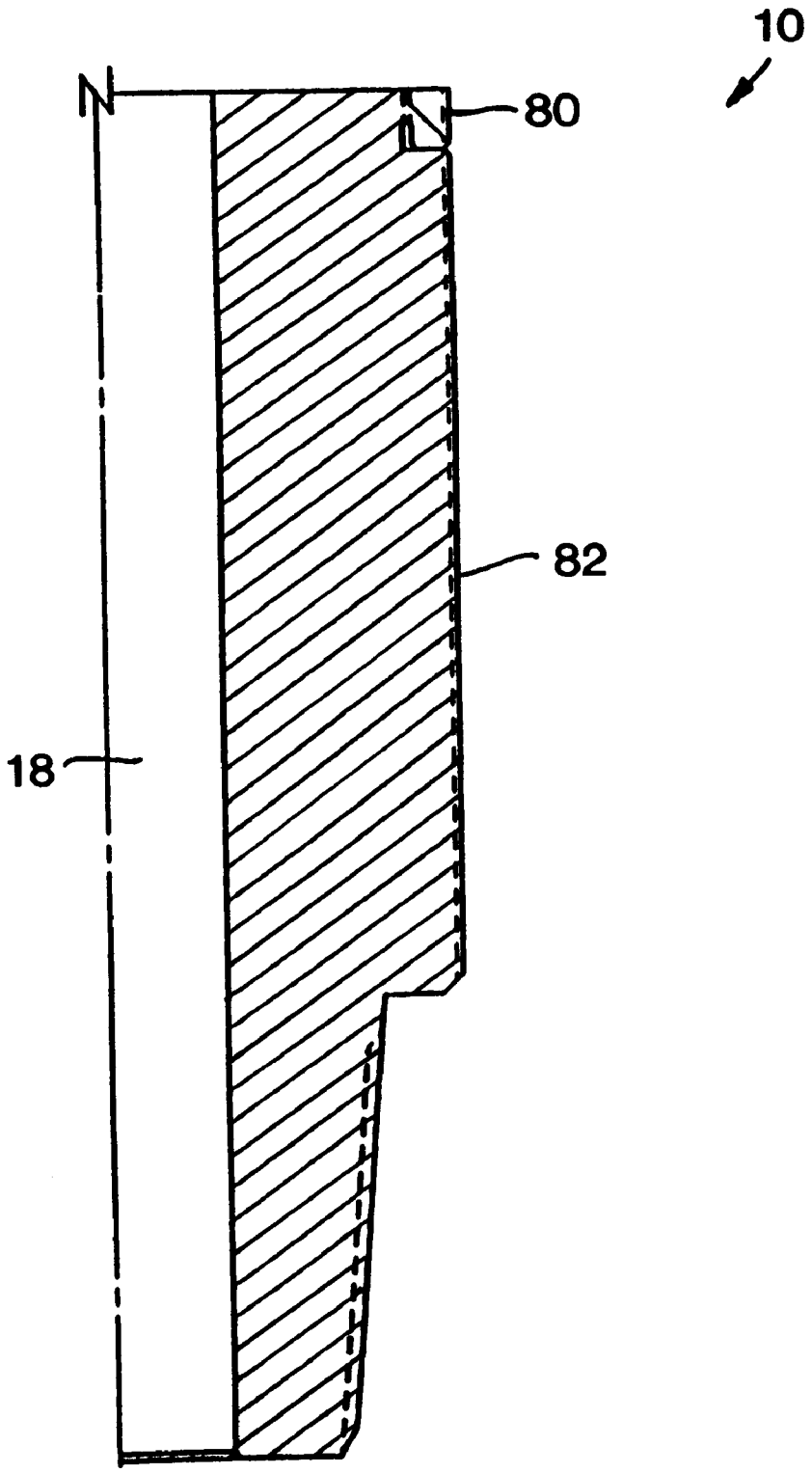

A generally axially extending opening 72 is formed in the lower centralizer housing 70 and is in fluid communication with the fluid passage 40. Referring specifically now to FIG. 1E, it may be seen that the opening 72, and thus the fluid passage 40, is in fluid communication with a coupling 74 which, in turn, is in fluid communication with an instrument 76.

The instrument 76 is disposed radially between an axially extending generally tubular inner instrument housing 78 and an axially extending generally tubular outer instrument housing 80. Each of the inner and outer instrument housings 78, 80 are threadedly attached to the lower centralizer housing 70, and the outer instrument housing 80 is threadedly attached to an axially extending generally tubular lower connector 82. The inner instrument housing 78 is sealingly attached to the lower centralizer housing 70 and to the lower connector 82. The lower connector 82 permits the apparatus 10 to be sealingly and threadedly attached to additional portions of the tubular string below the apparatus. An opening 84 is formed radially through the outer instrument housing 80 opposite the instrument 76, thereby providing fluid communication, if desired, between the instrument 76 and the annulus 44, and preventing retention of atmospheric pressure radially between the inner and outer instrument housings 78, 80. Note that the opening 84 could also be ported to the flow passage 18 through the inner instrument housing 78, in which case the outer instrument housing 80 would preferably sealingly engage the lower centralizer housing 70 and the lower connector 82.

Figure 3:
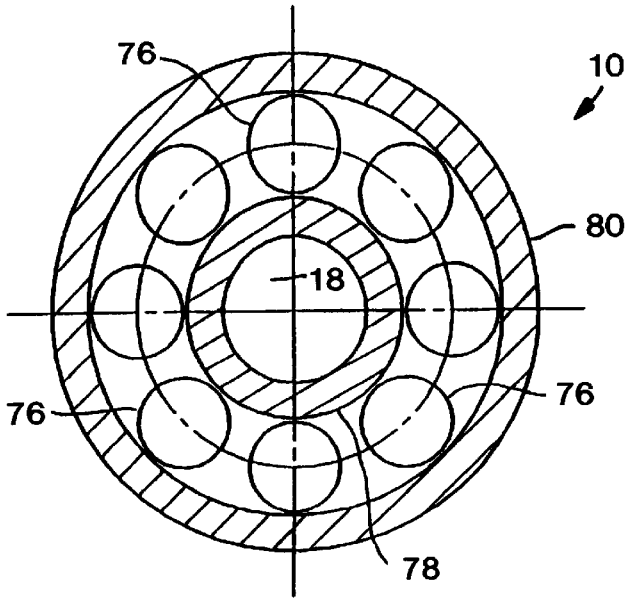
FIG. 3 is a cross-sectional view of the apparatus of FIGS. 1A–1F, taken along line 3—3 of FIG. 1E.

It may now be fully appreciated that when fluid from the annulus 44 is forced into the fluid passage 40 as hereinabove described, the instrument 76 is exposed to that fluid. Referring additionally now to FIG. 3, a cross-sectional view of the apparatus 10 is shown, taken along line 3—3 of FIG. 1E. In FIG. 3 it may be clearly seen that there may be more than one instrument 76 disposed between the inner and outer instrument housings 78, 80, representatively eight of them. The instruments 76 may be any combination of temperature gauges, pressure gauges (including differential pressure gauges), gamma ray detectors, resistivity meters, etc., which may be useful in measuring and recording characteristics of the fluid drawn into the fluid passage 40, or of the surrounding subterranean formation, etc. If more than one instrument 76 is utilized, more than one opening 72 may be provided in fluid communication with fluid passage 40. Various ones of the instruments 76 may also be ported directly to the annulus 44, to the flow passage 18, or to any other desired location.

It is to be clearly understood that the instruments 76 may be otherwise installed in the apparatus 10 without departing from the principles of the present invention. For example, a type of instrument known as a flowmeter 102 (not shown in FIGS. 1A–1F, see FIGS. 4A–4D) may be installed in the fluid passage 40, interconnected between the check valve 38 and the coupling 60. In this manner, the volume of fluid drawn into the apparatus 10 from the formation may be accurately determined. The flowmeter 102 may be a conventional flowmeter, may operate by transmission of acoustic waves, optical waves, neutron pulses, chemical injected into the fluid, radar, may include a spinner, propeller, paddle wheel or other mechanical device, etc.

Of course, the flowmeter 102 may be otherwise positioned, such as in the exhaust flow passage 42, and may be configured to determine a volume of fluid injected into a formation as well. In a similar manner, other instruments, such as sample chambers, resistivity meters, gamma ray detectors, etc. may be interconnected in various fluid passages of the apparatus 10.

It is important to understand that the fluid forced into the fluid passage 40 by the apparatus 10, although received from the annulus 44, is preferably indicative of characteristics of a particular formation intersected by the wellbore. This result is accomplished by inflating a pair of packers 86, 88 axially straddling the coupling 60, so that the packers sealingly engage the sides of the wellbore. In this manner, the fluid drawn from the annulus 44 into the fluid passage 40 is in fluid communication with the formation, but is isolated from the remainder of the wellbore.

Inflatable packers are well known in the art. They are typically utilized in uncased wellbores where it is desired to radially outwardly sealingly engage the sides of the wellbores with tubular strings disposed in the wellbores. However, the applicants have uniquely configured the packers 86, 88 so that they are closely axially spaced apart and remain so when inflated, thereby enabling relatively short axial portions of a formation intersected by the wellbore (or a formation which is itself relatively thin) to be tested by the apparatus 10.

The upper packer 86 is threadedly and sealingly attached to the upper centralizer housing 22 and is threadedly and sealingly attached to the coupling 60. The lower packer 88 is threadedly and sealingly attached to the coupling 60 and is threadedly and sealingly attached to an axially extending generally tubular floating shoe 90. The shoe 90 is sealingly and axially slidingly disposed externally on the mandrel 56. Thus, it may be clearly seen that the packers 86, 88 are axially secured to the remainder of the apparatus 10 only at the upper centralizer housing 22. So configured, the packers 86, 88 are maintained in relatively close axial proximity to each other when they are inflated.

The packers 86, 88 are inflated by applying fluid pressure to the inflation flow passage 20, which produces a differential fluid pressure from the inflation flow passage to the annulus 44. When the packers 86, 88 are inflated, elastomeric seal elements 92, 94, respectively, are expanded radially outward into sealing contact with the sides of the wellbore, preferably axially straddling a formation or portion of a formation where it is desired to test properties of fluid therefrom, or inject fluid thereinto. Note that, although FIGS. 1A–1F do not show the packers 86, 88 inflated, they may be so inflated with the apparatus 10 in its representatively illustrated configuration.

Referring specifically now to FIG. 1C, it may be seen that the inflation flow passage 20 extends axially through the coupling 60 via an opening 96 formed axially therethrough. The packers 86, 88 are somewhat radially spaced apart from the mandrel 56 so that the inflation flow passage 20 also extends radially between the packers and the mandrel 56. In FIG. 1B it may be seen that the inflation flow passage 20 radially between the packers 86, 88 is in fluid communication with the openings 28 formed in the upper centralizer housing 22.

When the packers 86, 88 are not inflated they are protected from potentially abrasive contact with the sides of the wellbore by the flutes 30 on the upper centralizing housing 22 and by similar flutes 98 formed externally on the lower centralizer housing 70. Note that each of the flutes 98 may also be provided with a wear resistant coating 100 similar to the coating 32. Thus, the elastomeric seal elements 92, 94 are suspended radially away from the sides of the wellbore when the packers 86, 88 are not inflated.

In a preferred manner of using the apparatus 10, the valve actuating section, or other suitable equipment, and the apparatus 10 are interconnected in a drill string (the valve actuating section being in its open configuration) and are disposed within a subterranean wellbore. Normal drilling operations, such as a wiper trip, are commenced utilizing the drill string, and fluid, such as drilling mud, may be circulated through the drill string and returned to the earth's surface via the annulus 44 formed radially between the drill string and the sides of the wellbore. Periodically, the circulation of fluids is ceased, for example, to add drill pipe to the drill string at the earth's surface.

The valve actuating section, or other equipment, may be actuated to permit fluid communication between the interior of the drill string above the apparatus 10 and the inflation flow passage 20. Fluid pressure may then be applied to the interior of the drill string at the earth's surface, which fluid pressure is thereby transmitted to the inflation flow passage 20 in order to inflate the seal elements 92, 94. When the seal elements 92, 94 have been sufficiently inflated such that they sealingly engage the sides of the wellbore axially straddling a desired formation or portion of a formation, the formation is substantially isolated from the remainder of the wellbore.

Referring additionally now to FIGS. 4A–4D, a method 110 of displacing fluid between a formation 112 intersected by a wellbore 114 and the apparatus 10 is schematically and representatively illustrated. Only an axial portion of the apparatus 10 is depicted in FIGS. 4A–4D for illustrative clarity.

Figure 4A:
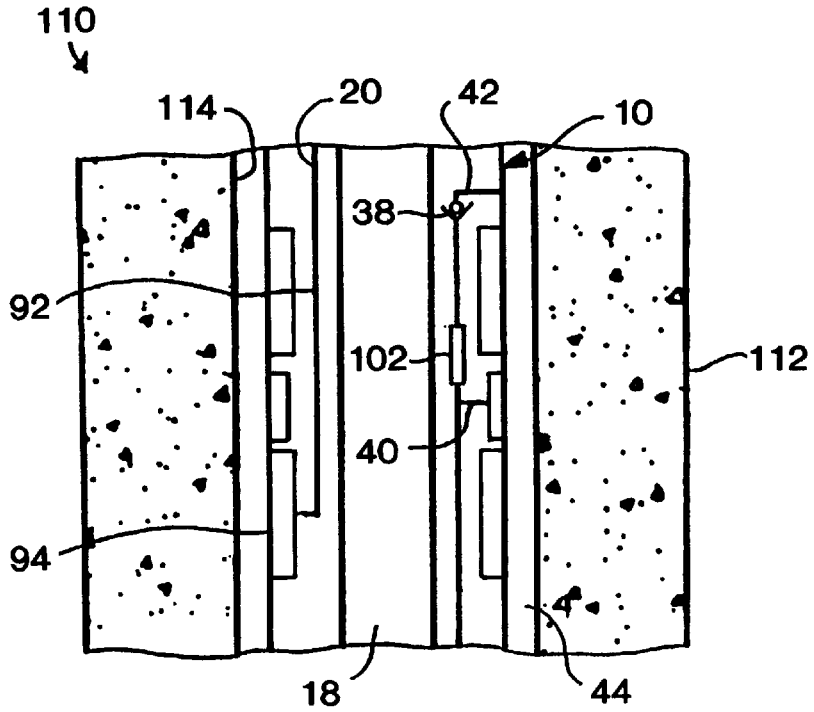
FIGS. 4A–4D are schematicized views of the apparatus of FIGS. 1A–1F as operatively installed in a subterranean well according to a method embodying principles of the present invention.

In FIG. 4A the apparatus 10 is shown installed in the wellbore 114 radially opposite the formation 112, or interval of the formation, from which it is desired to draw fluid. The seal elements 92, 94 are radially inwardly retracted, fluid pressure in the inflation flow passage 20 being equal to fluid pressure in the annulus 44. In this configuration, the apparatus 10 may be conveyed within the wellbore 114 during initial installation, during drilling operations, and for retrieval of the drill string to the earth's surface.

Figure 4B:
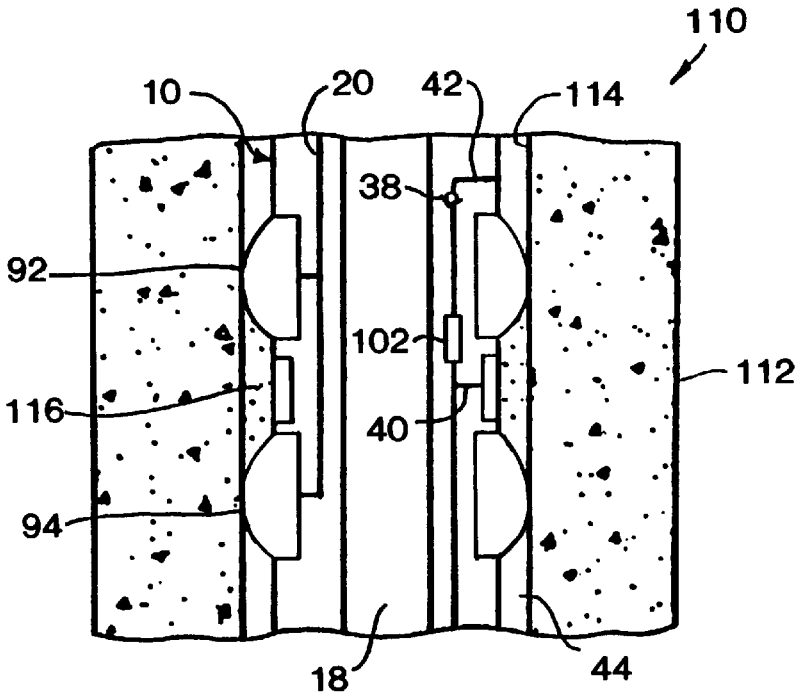

In FIG. 4B, fluid pressure has been applied to the inflation flow passage 20 as described above. The seal elements 92, 94 are, thus, radially outwardly extended into sealing engagement with the wellbore 114 at the formation 112. The portion of the formation 112 axially between the seal elements 92, 94 is substantially isolated from the remainder of the wellbore 114. Note that, at this point, a certain volume of fluid 116 is contained axially between the seal elements 92, 94 and radially between the apparatus 10 and the wellbore 114. Stated another way, an axial portion of the annulus 44 is isolated between the seal elements 92, 94. Such configuration of the apparatus 10 may result when approximately 200 psi has been applied to the inflation flow passage 20 (that is, a 200 psi differential from the inflation flow passage to the annulus 44).

Figure 4C:
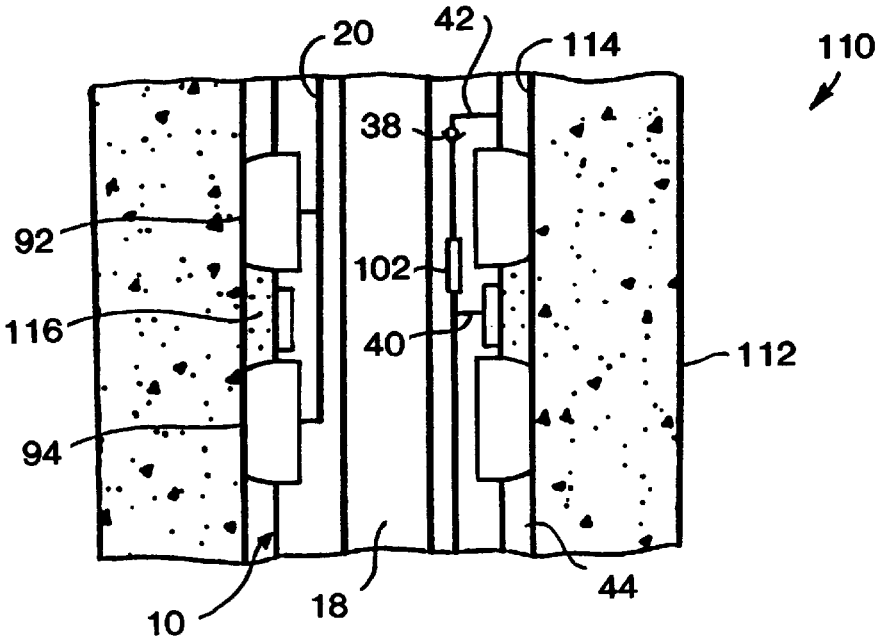

In FIG. 4C, additional fluid pressure has been applied to the inflation flow passage 20. Such additional fluid pressure has resulted in the seal elements 92, 94 becoming axially closer to each other as the portions of the seal elements sealingly engaging the wellbore 114 become increasingly axially elongated. Stated another way, respective portions of the seal elements 92, 94 radially outwardly extended relative to the remainder of the apparatus 10 are increased. This causes the annular volume containing the fluid 116 between the seal elements 92, 94 to decrease, thereby forcing the fluid into the fluid passage 40. Such configuration of the apparatus 10 may result when approximately 1,000 psi has been applied to the inflation flow passage 20.

The fluid 116 is permitted to flow through the fluid passage 40 to the instruments 76, and through the check valve 38 to the exhaust flow passage 42. The fluid 116 may then flow into a portion of the annulus 44 above the seal element 92. Note that the fluid 116 may additionally or alternatively be exhausted to the annulus 44 below the seal element 94 by appropriate routing of the exhaust flow passage 42.

Figure 4D:
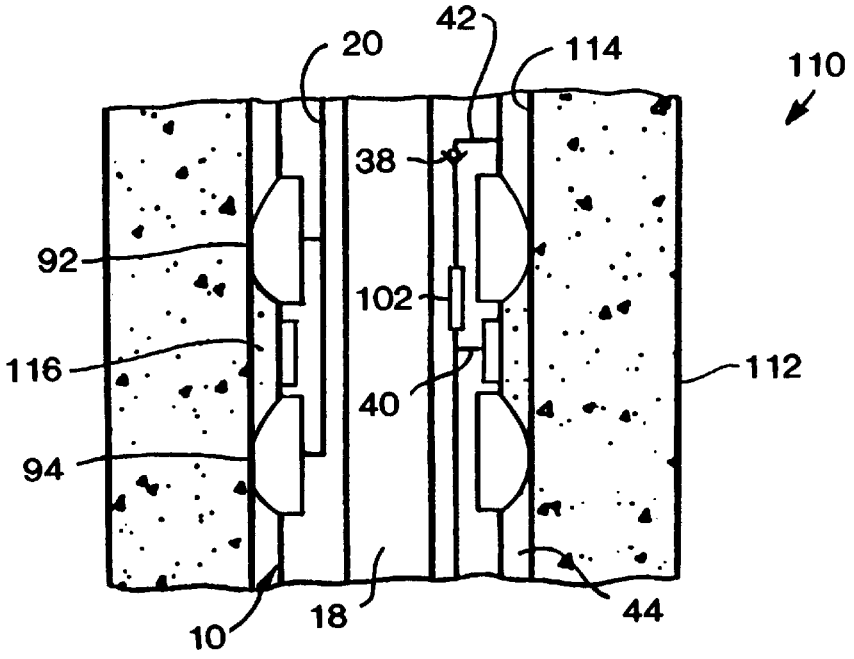

In FIG. 4D, fluid pressure in the inflation flow passage 20 has been decreased, thereby enlarging the annular volume between the seal elements 92, 94 and drawing fluid from the formation 112. Such configuration of the apparatus 10 may result when the fluid pressure in the inflation flow passage 20 is approximately 500 psi.

It will be readily appreciated by a person of ordinary skill in the art that the apparatus 10 may be cycled repeatedly between the configurations shown in FIGS. 4C and 4D, to thereby pump any desired volume of fluid from the formation into the fluid passage 40, and then through the exhaust flow passage 42 to the annulus 44. This pumping operation is performed by alternately increasing and decreasing the fluid pressure in the inflation flow passage 20 to thereby respectively decrease and increase the annular volume between the seal elements 92, 94, resulting in respective compression and decompression of the fluid 116 therein. In this manner, the inflatable packers 86, 88 operate as an external fluid pump for alternately forcing the fluid 116 into the fluid passage 40 and drawing fluid from the formation 112.

Of course, as described hereinabove, the check valve 38 may be reversed, so that when fluid pressure in the inflation flow passage is decreased, fluid is drawn from the annulus 44 through the check valve and into the annular volume between the seal elements 92, 94. In this manner, a stimulation operation could be performed in which stimulation fluids (disposed in the annulus 44 above the seal element 92, or in a chamber interconnected to the exhaust flow passage 42) are drawn into the annular volume, and then injected into the formation 112 when fluid pressure in the inflation flow passage 20 is increased.

In a common type of formation test, the fluid pressure in the wellbore adjacent to the desired formation or formation portion is lowered and a recording is made of the fluid pressure and rate of change of fluid pressure, giving those skilled in the art an indication of characteristics of the formation, such as the formation's permeability, etc. Such formation tests and others may be accomplished by the hereinabove described drawing of fluid 116 from the annular volume between the seal elements 92, 94 into the fluid passage 40, while corresponding fluid pressures, temperatures, etc. are recorded by the instruments 76 in the apparatus 10. Note that the instruments 76 may record continuously from the time they are inserted into the wellbore until they are withdrawn therefrom, or they may be periodically activated and/or deactivated while they are in the wellbore.

When the testing operation is concluded, the differential fluid pressure is released from the inflation flow passage 20 to permit the seal elements 92, 94 to deflate radially inwardly. The above sequence of performing drilling operations, testing a formation intersected by the wellbore, and then resuming drilling operations may be repeated as desired, without the necessity of withdrawing the drill string from the wellbore to separately run testing tools therein. Of course, if the instruments 76 are battery-powered or are otherwise subject to time limitations, it may be necessary to periodically retrieve the instruments.

It will be readily apparent to one of ordinary skill in the art that the apparatus 10 is of particular benefit in generally horizontally oriented portions of subterranean wellbores. However, it is to be understood that the apparatus 10 may be utilized to great advantage in vertical and inclined portions of wellbores as well. The apparatus 10 may also be utilized in cased wellbores, in the event that an opening is provided through the casing, and may also be utilized in operations wherein, strictly speaking, drilling of a wellbore is not also performed. For example, the apparatus 10 may be used to find and/or evaluate leaks in tubular strings in a well by attempting to draw or inject fluid through the wall of the tubular string.

It will also be readily apparent to one of ordinary skill in the art that the various load-carrying elements of the apparatus 10 as representatively illustrated are joined utilizing straight threads which may not be suitable for applications wherein high torque loads are to be encountered, but it is to be understood that other threads may be utilized, and other modifications may be made to the elements of the apparatus 10 without departing from the principles of the present invention. For example, instead of further inflating the seal elements 92, 94 after they sealingly engage the wellbore 114, the seal elements could be axially displaced toward each other, another member could be inserted into the annular volume between the seal elements to decrease the volume and force the fluid 116 into the fluid passage 40, etc. As another example, the seal elements 92, 94 could be of the type used on production packers, and another means could be provided for compressing the fluid between the seal elements.

Of course, a person of ordinary skill in the art would find it obvious to make modifications, additions, deletions, substitutions, and other changes to the apparatus 10 and method 110, and these are contemplated by the principles of the present invention. Accordingly, the foregoing detailed description is to be clearly understood as being given by way of illustration and example only, the spirit and scope of the present invention being limited solely by the appended claims.

What is claimed is:

1. A method of displacing fluid between a formation intersected by a wellbore and an apparatus disposed within the wellbore, the method comprising the steps of:

providing the apparatus including axially spaced apart and radially outwardly extendable seal elements;

extending the seal elements into sealing engagement with the formation; and compressing the fluid between the seal elements, by expanding the seal elements toward one another, in a manner causing the fluid to be pumped between one of the formation and the apparatus and the other of the formation and the apparatus.

2. The method according to claim 1, wherein the seal elements are inflatable packers, and wherein the compressing step is performed by continuing to inflate the packers after the packers have sealingly engaged the formation.

3. The method according to claim 1, wherein the compressing step further comprises forcing the fluid through an internal fluid passage of the apparatus.

4. The method according to claim 3, wherein the forcing step further comprises forcing the fluid from a first annulus, formed between the wellbore and a first portion of the apparatus axially between the seal elements, to a second annulus formed between the wellbore and a second portion of the apparatus axially separated from the first apparatus portion.

5. The method according to claim 3, wherein the forcing step further comprises forcing the fluid through the fluid passage, the fluid passage providing fluid communication between a first annulus, formed between the wellbore and a first portion of the apparatus axially between the seal elements, and a second annulus formed between the wellbore and a second portion of the apparatus axially separated from the first apparatus portion.

6. The method according to claim 3, wherein the forcing step further comprises forcing the fluid through a flow control device interconnected in the fluid passage.

7. The method according to claim 6, further comprising the step of utilizing the flow control device to permit fluid flow through the fluid passage from a first annulus, formed between the wellbore and a first portion of the apparatus axially between the seal elements, to a second annulus formed between the wellbore and a second portion of the apparatus axially separated from the first apparatus portion, and to prevent fluid flow through the fluid passage from the second annulus to the first annulus.

8. The method according to claim 6, further comprising the step of utilizing the flow control device to prevent fluid flow through the fluid passage from a first annulus, formed between the wellbore and a first portion of the apparatus axially between the seal elements, to a second annulus formed between the wellbore and a second portion of the apparatus axially separated from the first apparatus portion, and to permit fluid flow through the fluid passage from the second annulus to the first annulus.

9. The method according to claim 1, wherein the extending step further comprises forming an annular volume radially between the apparatus and the formation, and axially between the seal elements.

10. The method according to claim 9, wherein the compressing step further comprises decreasing the annular volume.

11. The method according to claim 10, further comprising the step of increasing the annular volume.

12. The method according to claim 10, further comprising the step of alternately increasing and decreasing the annular volume.

13. The method according to claim 10, wherein the decreasing step is performed by decreasing an axial distance between sealing engagements of the seal elements with the formation.

14. The method according to claim 10, wherein the decreasing step is performed by increasing respective portions of the seal elements radially outwardly extended relative to the remainder of the apparatus.

15. A method of drawing fluid from a formation intersected by a wellbore, the method comprising the steps of:

using a seal structure to sealingly engage the formation and substantially isolate a volume of the wellbore adjacent the formation from the remainder of the wellbore;

placing a fluid passage in fluid communication with the volume; and compressing the volume, to thereby force fluid to flow between the volume and the fluid passage, utilizing the seal structure.

16. The method according to claim 15, wherein the compressing step further comprises extending the seal structure in a direction toward the volume.

17. The method according to claim 15, wherein the compressing step further comprises displacing the seal structure relative to the volume.

18. The method according to claim 15, wherein the using step is performed using a seal structure having at least two seal element, with the volume being formed between the seal elements.

19. The method according to claim 18, wherein the compressing step further comprises displacing the seal elements toward each other.

20. The method according to claim 18, wherein the compressing step further comprises displacing the seal elements radially outward.

21. The method according to claim 18, further comprising the step of interconnecting a flow control device with the fluid passage.

22. The method according to claim 21, further comprising the step of utilizing the flow control device to prevent fluid flow through the fluid passage to the volume.

23. The method according to claim 15, further comprising the step of pumping fluid from the formation through the volume and into the fluid passage by alternately expanding and compressing the volume.

24. Apparatus operatively positionable within a subterranean wellbore opposite a formation intersected by the wellbore, the apparatus comprising:

a fluid pump externally disposed on the apparatus and operative to sealingly engage the formation, substantially isolate a volume of the wellbore adjacent the formation, and pump fluid between the volume and the apparatus; and a fluid passage disposed relative to the fluid pump and operative to permit fluid communication between the interior of the apparatus and the volume.

25. The apparatus according to claim 24, further comprising a fluid property sensor interconnected with the fluid passage.

26. The apparatus according to claim 24, further comprising a flow control device interconnected with the fluid passage.

27. The apparatus according to claim 26, wherein the flow control device permits fluid flow from the volume to the interior of the apparatus and prevents fluid flow from the interior of the apparatus to the volume.

28. The apparatus according to claim 24, wherein the fluid pump comprises a radially outwardly extendable seal structure operative to sealingly engage the formation.

29. The apparatus according to claim 24, wherein the fluid pump comprises at least two seal elements operative to sealingly engage the formation and thereby form the volume between the seal elements.

30. The apparatus according to claim 29, wherein the seal elements are inflatable packer elements.

31. Apparatus extending along an axis and operatively positionable within a subterranean well, the apparatus comprising:

first and second axially spaced apart and radially outwardly extendable seal elements sealingly engageable with a portion of the well to substantially isolate, in the space between the first and second seal elements, a volume of fluid;

an interior fluid passage communicatable with the volume of fluid between the first and second seal elements; and a flow control device interconnected with the fluid passage, the first and second seal elements being axially expandable toward one another in a manner responsively pumping the volume of fluid out of the space between the first and second seal elements.

32. The apparatus according to claim 31, wherein the interior fluid passage further permits fluid communication with a second exterior portion of the apparatus, the first seal element being disposed between the first and second exterior portions.

33. The apparatus according to claim 32, wherein the flow control device prevents fluid flow through the fluid passage from one of the first and second exterior portions to the other of the first and second exterior portions.

34. The apparatus according to claim 31, wherein at least one of the first and second seal elements is an inflatable packer element.

35. The apparatus according to claim 31, further comprising at least one instrument interconnected with the fluid passage.

36. The apparatus according to claim 35, wherein the at least one instrument is a pressure sensor.

37. The apparatus according to claim 35, wherein the at least one instrument is a flowmeter.

38. The apparatus according to claim 35, wherein the at least one instrument is interconnected in the fluid passage between the flow control device and the first exterior portion of the apparatus.

39. The apparatus according to claim 31, further comprising a fluid conduit interconnected to the first and second seal elements, fluid pressure in the fluid conduit being operative to radially outwardly extend the seal elements.

* * * * *